United States Patent [19]

Hartness et al.

[11] 4,078,361

[45] Mar. 14, 1978

[54] APPARATUS FOR CONTROLLING THE FLOW OF ARTICLES TO A CASE PACKER

[76] Inventors: Thomas P. Hartness, 305 Bridgewater Dr.; Robert G. Hartness, 203 Wilmington Rd., both of Greenville, S.C. 29607

[21] Appl. No.: 741,707

[22] Filed: Nov. 15, 1976

[51] Int. Cl.[2] ..... B65B 21/16

[52] U.S. Cl. ..... 53/166; 53/248; 198/425; 198/491

[58] Field of Search ..... 53/61, 62, 159, 166, 53/247, 248, 262; 198/424, 425, 491

[56] References Cited

U.S. PATENT DOCUMENTS

| | | | |
|---|---|---|---|
| 2,350,560 | 6/1944 | Kimball | 53/62 |
| 2,755,611 | 7/1956 | McGihon | 53/166 X |
| 2,898,715 | 8/1959 | Cella | 53/62 |
| 3,060,659 | 10/1962 | Blais et al. | 53/61 |
| 3,325,967 | 6/1967 | Wild | 53/262 |
| 3,735,852 | 5/1973 | O'Keefe | 83/613 |

*Primary Examiner*—Robert Louis Spruill
*Attorney, Agent, or Firm*—Bailey, Dority & Flint

[57] ABSTRACT

An apparatus for controlling the flow of articles being fed to a case packer in rows upon a conveyor. The case packer has an article supporting member which is shifted laterally for depositing a predetermined number of articles into the case. The apparatus includes a plurality of vertically extending abutments which are carried below the path of travel of the articles between the conveyor and the case packer. The vertically extending abutments are selectively raised into the path of travel of the articles for preventing the articles from being fed from the conveyor onto the article supporting member when articles are being deposited into the case.

5 Claims, 5 Drawing Figures

APPARATUS FOR CONTROLLING THE FLOW OF ARTICLES TO A CASE PACKER

BACKGROUND OF THE INVENTION

The present invention relates to a device for controlling the flow of articles to a case packer, and more particularly to a device which prevents articles from being fed onto a case packer during the time that other articles are being loaded into a case. Case packing machines such as utilized for depositing articles into cartons or cases are well known, and one such case packing machine is disclosed in U.S. Pat. No. 3,788,034. In the article loading machine disclosed in that patent 24 bottles are deposited into cases simultaneously. These bottles are lowered through a grid set into the case. The bottles are fed to the case packer on a continuously moving conveyor, therefore, it is necessary to restrain the bottles to prevent them from being delivered from the conveyor to the case packing machine when the bottles are being loaded into the case. As illustrated, this is accomplished by means of a presser plate which bears down on the top of the seventh and eighth bottles in each of the rows so as to prevent them from being pushed onto the case packer. After the first six bottles of each row have been deposited into the case by laterally shifting the bottle supporting member, the bottle supporting member is shifted laterally back to its bottle supporting position. The presser plate is raised off of the bottles and additional bottles are permitted to be loaded onto the case packer.

In another device, such as disclosed in U.S. Pat. No. 3,325,967 additional bottles are prevented from being fed to the case packer by stop pins which are shifted laterally when the bottles are being loaded into the case packer. One problem with utilizing the laterally shifting pins for preventing the flow of bottles to the case packer is that if a bottle is out of alignment, the pin will strike the bottle preventing the supporting bars which permit the bottles to be dropped into cases from being shifted laterally. Another problem incurred by using a pin or stop which is shifted laterally into the path of bottles is that the diameter or thickness of the vertically extended stop is limited to the thickness of the guide plates so as to permit the bottles to pass between the guide plates when the stops are retracted. As a result, the pins or stops tend to break off, bend or wear out. Furthermore, since the stops are shifted laterally they only engage one side of the bottle as illustrated in FIGS. 2*a* and 2*b* of U.S. Pat. No. 3,325,967.

SUMMARY OF THE INVENTION

The invention pertains to an apparatus for controlling the flow of articles being fed to a case packer in rows on a continuously moving conveyor. The case packer includes an article supporting member which is shifted laterally for depositing a predetermined number of articles into a case. A plurality of vertically extending abutments are carried below the path of travel of the articles between the conveyor and the case packer. Means is provided for selectively raising the abutments into the path of travel of the articles for preventing the articles from being fed from the conveyor onto the article supporting member while the case is being loaded. The abutments are integral with the top side of a vertical plate that rides on outwardly extending bolts carried by a frame forming part of the article supporting member. The plate has slots provided therein through which the bolts extend so that as the article supporting member is shifted laterally, the lateral movement of the bolts cause the plate to rise vertically into the path of the bottles being fed onto the article supporting member.

Accordingly, it is an important object of the present invention to provide an apparatus for controlling the flow of articles such as bottles into a case packing machine.

Still another important object of the present invention is to provide an apparatus for controlling the flow of bottles to a case packer which includes abutments that are selectively raised vertically into the path of oncoming articles so as to restrict the forward motion thereof.

Still another important object of the present invention is to provide an apparatus for stopping the flow of articles being delivered on a conveyor to an article handling device with a minimum amount of damage to the bottles and labels.

These and other objects and advantages of the invention will become apparent upon reference to the following specification, attendant claims and drawing.

DESCRIPTION OF A PREFERRED EMBODIMENT

Figure 1:
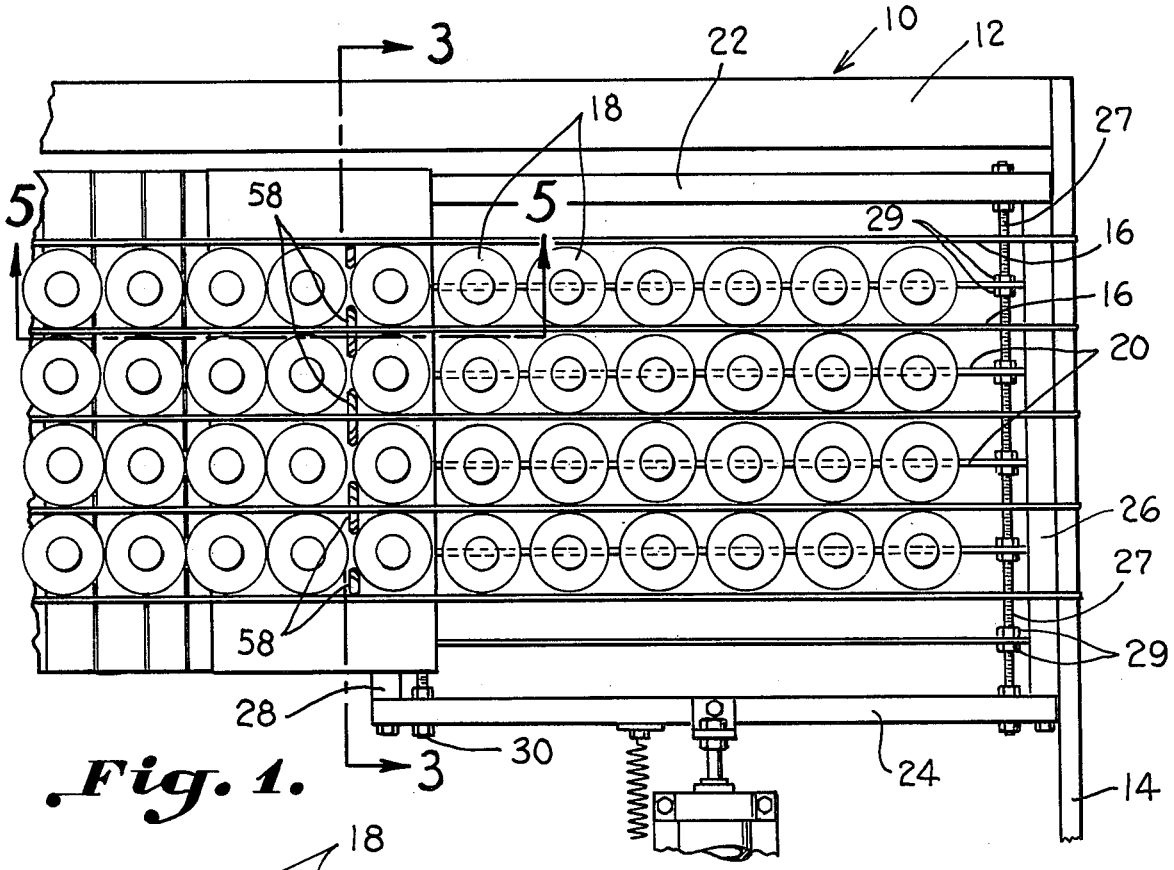
FIG. 1 is a plan view illustrating bottles being fed on a conveyor to a case packing machine.
Figure 2:
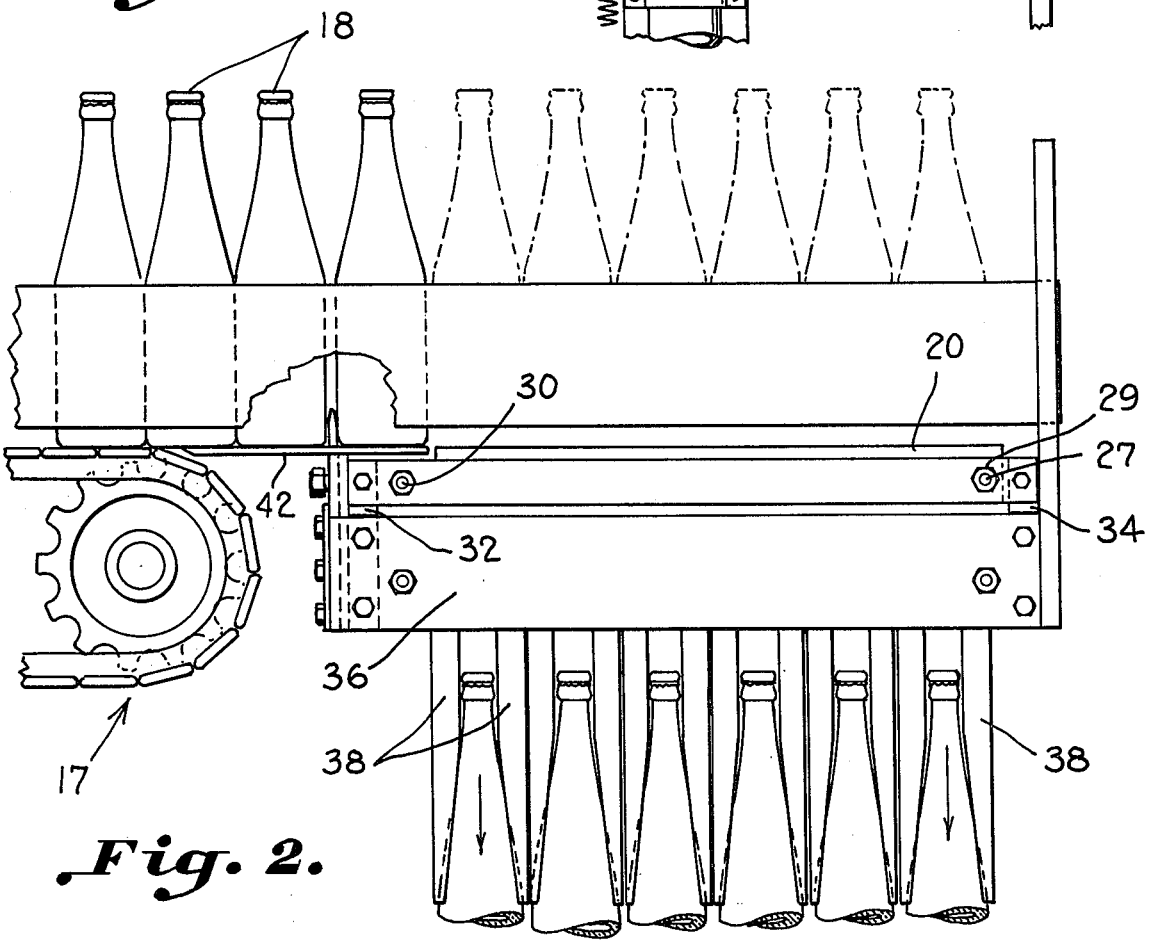
FIG. 2 is a side elevational view of the conveyor and case packing machine of FIG. 1.

Referring in more detail to the drawings, there is illustrated a case packer generally designated by the reference character 10 such as illustrated in more detail in U.S. Pat. No. 3,788,034. The case packer includes a frame composed of side rail 12 and end member 14. Divider plates 16 extend from the end member 14 back over the conveyor, generally designated by the reference character 17 for maintaining articles such as bottles 18 in rows. These bottles as they are fed onto the case packer are supported on laterally spaced vertically extending bars 20 which form part of an article supporting frame. The article supporting frame includes side walls 22 and 24 which are joined by end walls 26 and 28 to form a substantially rectangular shaped frame. Extending between the side walls 22 and 24 is a threaded rod 27 upon which the spaced article supporting bars 20 are carried. Nuts 29 are threaded on the rod 27 so as to properly position the article supporting vertically extending plates 20 on the rod 27.

A similar rod 30 is carried between the side walls 22 and 24 of the article shifting frame adjacent the other end thereof for supporting the other ends of the vertical article supporting plates 20. The article supporting frame rides on nylon surfaces 32 and 34 which are carried on top of a frame 36 for a grid set. The grid set frame in turn, has spring biased fingers 38 which extend downwardly therefrom through which the bottles pass when being deposited into a case.

The nylon surfaces 32 and 34 permit the article supporting member to be shifted laterally relative to the grid set for permitting bottles 18, which are supported on the vertically spaced support members 20 to be deposited into the case.

Figure 4:
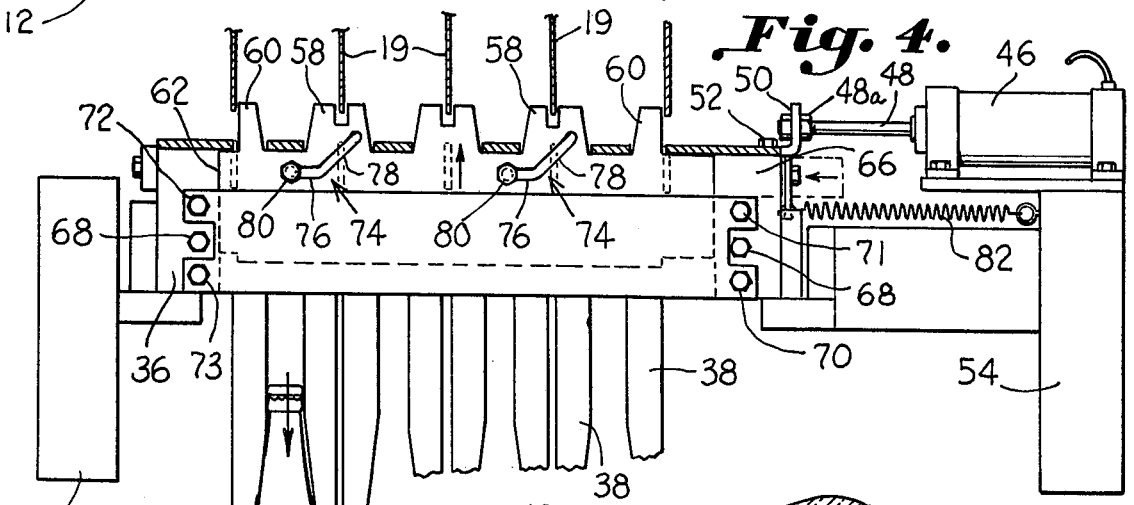
FIG. 4 is a sectional view illustrating the abutments in a raised position.
Figure 5:
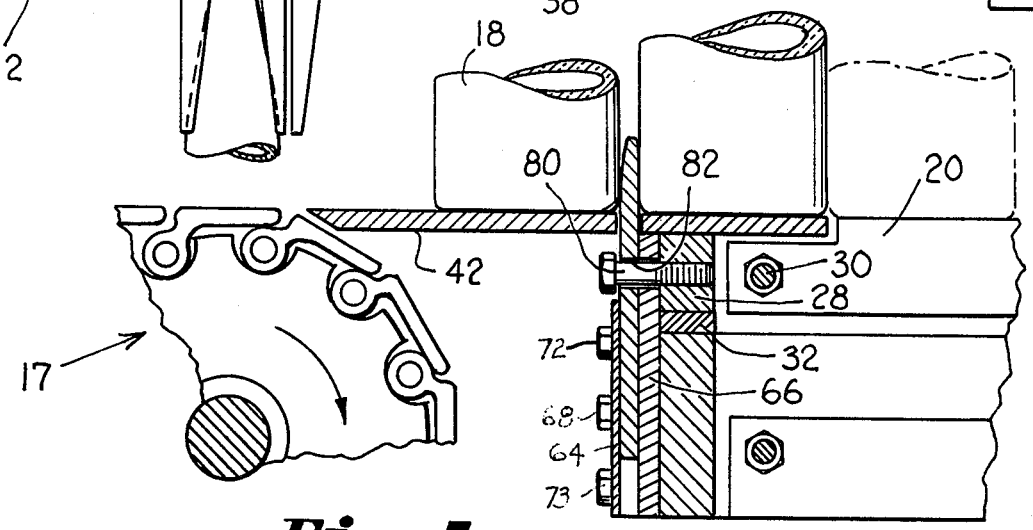
FIG. 5 is an enlarged sectional view taken along line 5—5 of FIG. 1.

The bottles 18 are continuously fed to the case packer 10 by a conventional conveyor, generally designated by the reference character 17 which forces the bottles over a horizontal plate 42 onto the supporting vertically extending plates 20 when they are being loaded onto the case packer. After six bottles are positioned on the article supporting members 20 in four rows so as to make up a total of twenty-four bottles, a switch is triggered in a conventional manner. A signal produced by the closing of the switch causes a solenoid valve to be energized permitting air to be fed through line 44 of cylinder 46. This causes the piston associated with the cylinder 46, and accordingly, a piston rod 48 to be shited to the left as illustrated in FIGS. 4 and 5. As the piston rod 48 is shifted to the left. Nuts 48*a* and 48*b* carried on the end thereof engage a vertically extending flange 50 shifting the article supporting frame to the left causing the bottles 18 to be deposited in the case. A bolt 52 secures the flange 50 to the side rail 24 of the article supporting member.

It is noted that the cylinder 46 is suitably mounted by means of bolts on top of a horizontally extending beam 54. Positioned on the opposite side of the case packer is the other beam 12. The grid set is suitably mounted on flanges 58 and 60 extending outwardly from the beams 54 and 12.

Figure 3:
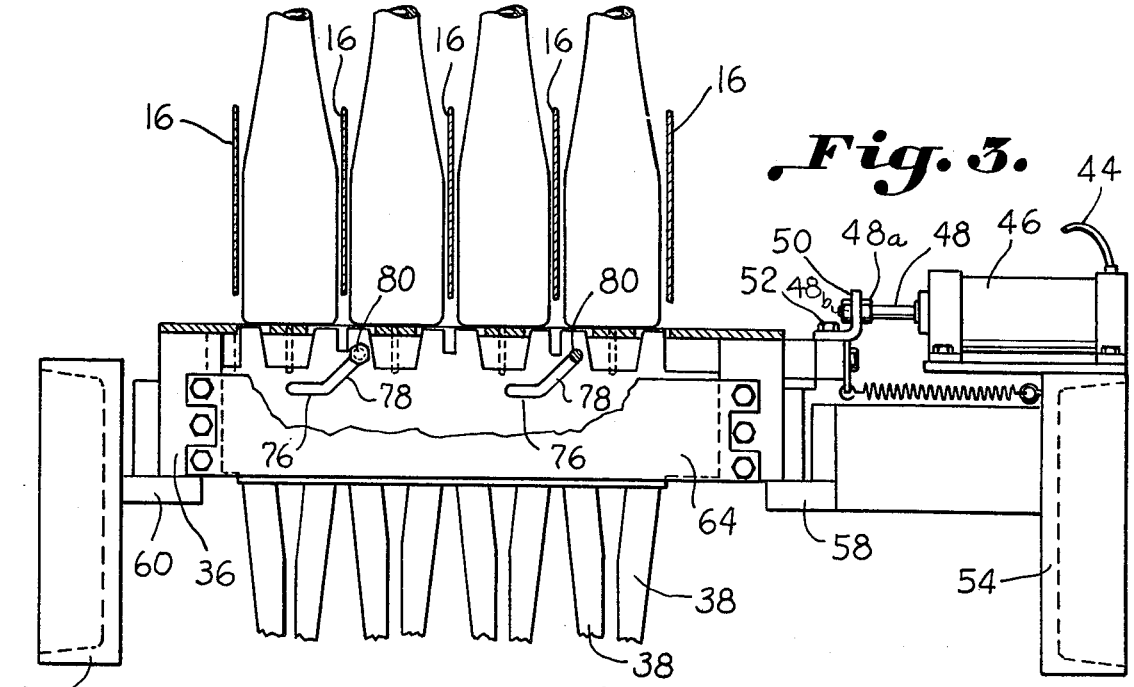
FIG. 3 is a sectional view taken along line 3—3 of FIG. 1 illustrating the abutments in a retracted position.

When the bottles are dropped through the grid set by laterally shifting the article supporting vertical members 20, it is necessary to prevent additional bottles from being fed onto the case packer. In order to accomplish this abutments 58 and 60 are raised from a retracted position such as illustrated in FIG. 3, to a raised position such as illustrated in FIGS. 4 and 5.

These abutments 58 and 60 are integral with the upper edge of a substantially rectangular shaped plate 62, the outline of which is shown in broken lines in FIG. 4. This plate 62 floats within a channel defined by cover plate 64 and at inner plates 66. The inner plate 66 is, in turn, bolted to the frame of the grid set by means of the bolts 68. The cover plate 64 is bolted to the inner plate by bolts 70, 71, 72 and 73. The inner plate 66 has a recess therein in which the vertical plate 62 is carried.

The vertical plate 62 has a pair of slots, generally designated by the reference character 74 provide therein. The slots include a horizontal portion 76 which terminates in an upwardly inclined portion 78.

A pair of bolts 80 extend through slots provided in the inner plate 66 and are secured to an end wall 28 of the movable frame forming part of the article supporting member. The slots 82 through which the bolts 80 extend are horizontal so as to enable the article supporting frame to be shifted laterally.

As previously mentioned, when the article supporting frame is shifted to the left as illustrated in FIG. 4, from the position illustrated in FIG. 3, the bolts 80 are also shifted to the left. Since the bolts extend through the sloping slots 74 provided in the plate 62 they cause the plate 62 to rise vertically. When the plate 62 rises vertically, the abutments 58 and 60 are moved into the path of the bottles being fed from the conveyor 64. As previously mentioned, the plate 62 is carried within a complementary shaped recess provided in the inner plate 66 so that the plate 62 more or less floats within this recess but is prevented by the ends of the recess from moving laterally with the article supporting frame.

After the articles have been deposited into the case, a switch is triggered in a conventional manner permitting the case to be lowered. Simultaneously therewith pressure is removed from the cylinder 46 and a spring 82 extending from frame 54 to the side 24 of the article supporting member is used for returning the article supporting member to its initial position such as illustrated in FIG. 3. As it is returned to its initial position, the bolts 80 extending through the slot 74 cause the plate 62 to be lowered out of the path of the incoming bottles. After the plate is completely lowered, 24 more bottles are fed from the conveyor 16 onto the article supporting plate 20 of the case packer.

As can be best seen in FIG. 1 of the drawings, the abutments 58 and 60 are raised within the gaps provided between abutting bottles 16. The abutment 60 is only one-half the size of the abutment 58 since they are on the end of the plate. The sides of the abutments 58 are inclined inwardly from the bottom towards the top so as to aid in clearing the bottles as they are raised if any of the bottles are out of alignment. The abutments 58 and 60 are also inclined from the bottom to the top in the direction of the flow of the bottles so as to minimize binding with the bottles and damage to the bottles and labels carried thereon.

The abutments 58 are slotted adjacent their top so that when they are raised they are permitted to extend upwardly slightly above the vertical divider plates 16 as illustrated in FIG. 4.

Since the stops 58 and 60 are raised vertically, as illustrated in FIG. 1 of the drawings, they extend in the gaps on both sides of the bottle for positively holding the bottles in position. The only limitation on the thickness of the abutments 58 and 60 is the size of the void between abutting bottles. In order to minimize the force required for raising and lowering the plate 62 upon which the abutments 58 and 60 are carried, the slot 74 through which the bolt 80 extends has a horizontal portion which enables the bottle supporting frame to begin its lateral movement prior to causing the plates 62 to be lowered.

While a preferred embodiment of the invention has been described using specific terms, such description is for illustrative purposes only, and it is to be understood that changes and variations may be made without departing from the spirit or scope of the following claims.

What is claimed is:

1. An apparatus for controlling the flow of articles being fed to a case packer in rows on a transporting surface of a conveyor, said case packer having an article supporting member which is shifted for depositing a predetermined number of articles into a case, said apparatus comprising:

a. a vertically extending plate carried between said case packer and said conveyor below the transporting surface of said conveyor;

b. a plurality of vertically extending abutments normally carried below the path of travel of said articles on an upper edge of said vertically extending plate;

c. an outwardly extending shaft carried on said article supporting member;

d. an inclined slot provided in said vertically extending plate;

e. means for shifting said article supporting member laterally between a position wherein said articles are deposited into said case and a position wherein said articles are supported above said case;

f. said shaft extending through said slot in said vertical plate for raising and lowering said vertical plate as said article supporting member is shifted laterally between a position wherein said articles are deposited into said case and a position wherein said articles are supported above said case;

whereby as said article supporting member is shifted for depositing said articles supported thereon into said case, said flow of articles being fed on said conveyor is restrained by said raised abutments during the case loading operation.

2. The apparatus as set forth in claim 1 wherein said plate upon which said abutments are carried is supported in a channel provided adjacent said article supporting member.

3. The apparatus as set forth in claim 1 wherein said inclined slot includes a horizontal portion which terminates in an upwardly inclined portion so that as said article supporting member is shifted laterally, said shaft moves freely through said horizontal portion until is reaches said inclined portion wherein it begins lowering said plate with said abutments thereon.

4. The apparatus as set forth in claim 1 wherein the sides of said abutments are inclined from adjacent their bottom towards their tops.

5. The apparatus as set forth in claim 1 wherein said abutments are inclined from adjacent their bottoms towards their tops in a direction of flow of said articles.

* * * * *